US005458310A

United States Patent [19]

Johnson

[11] Patent Number: 5,458,310

[45] Date of Patent: Oct. 17, 1995

[54] ADJUSTABLE AND SELF-HOLDING SUPPLY ROLL SYSTEM FOR PLOTTING DEVICES

[75] Inventor: Dave W. Johnson, Anaheim, Calif.

[73] Assignee: Calcomp Inc., Anaheim, Calif.

[21] Appl. No.: 164,086

[22] Filed: Dec. 8, 1993

[51] Int. Cl.[6] ..... B65H 18/28

[52] U.S. Cl. ..... 248/251; 242/598; 242/598.3; 242/599.1; 248/201

[58] Field of Search ..... 248/201, 251, 248/268, 267, 309.2; 211/105.1, 105.6, 123; 242/598.3, 598.4, 599.1, 599.3, 599.4, 160.1, 598

[56] References Cited

U.S. PATENT DOCUMENTS

| | | | |
|---|---|---|---|
| 527,273 | 10/1894 | Fowler et al. | 211/105.6 |
| 689,834 | 12/1901 | Tilton | 242/599.4 X |
| 763,486 | 6/1904 | Heinrich | 248/267 |
| 953,657 | 3/1910 | Aldhouse | 248/267 |
| 2,032,440 | 3/1936 | Schenker | 242/599.1 |
| 2,858,994 | 11/1958 | Sarro | 242/599.3 X |
| 3,734,424 | 5/1973 | Ulseth | 242/422.9 |
| 4,390,139 | 6/1983 | Alexander, III | 242/160.1 X |
| 4,721,267 | 1/1988 | Nieto et al. | 242/598.4 |

*Primary Examiner*—Ramon O. Ramirez
*Assistant Examiner*—Derek J. Berger
*Attorney, Agent, or Firm*—William F. Porter; Richard T. Lyon

[57] ABSTRACT

This is a system for holding a supply roll of media in a plotter or the like. One support bar is of fixed length and has a sliding lockable collar for use with different widths of media. Another support bar is of adjustable length for use in plotters employing different widths of media. The end holder for the support bar includes a biased member holding the end in a U-shaped slot to resist lifting from forces on the supply roll as the media is removed.

18 Claims, 5 Drawing Sheets

ADJUSTABLE AND SELF-HOLDING SUPPLY ROLL SYSTEM FOR PLOTTING DEVICES

BACKGROUND OF THE INVENTION

1. Technical Field

This invention relates to supply roll holders for roll-fed plotting devices and the like and, more particularly, to a support bar system for holding rolled media in a plotter or the like comprising, a support bar having a first end and a second end, the support bar being adjustable for different widths of rolled media; a first end holder holding and supporting the first end; a second end holder holding and supporting the second end, the second end holder including a U-shaped slot receiving the second end; and, biasing means for holding the second end in the U-shaped slot against lifting forces imparted as roll media supported by the support bar is unrolled, wherein the biasing means comprises, a biasing member pivotally mounted in the U-shaped slot, and biasing means for urging the biasing member towards the second end.

2. Background Art

Various types of plotting devices have the plotting media supplied from a roll as opposed to having single cut sheets inserted one at a time. The typical prior art approach to supporting the supply roll 10 is shown in FIG. 1. The supply roll 10 is supported on a support bar 12. The support bar 12, in turn, is supported by a pair of end cups 14 carried by respective ones of a pair of vertical side members 16 of the plotter.

Such an approach works for its intended purpose; but, has certain problems and limitations that effect its convenience for users. Typically, the end cups 14 are configured like those employed to hold up a clothes bar in a closet; that is, one is a complete cup which encircles the end of the support bar 12 while the other is U-shaped. One end of the support bar 12 is inserted into the closed cup and then the other end of the support bar 12 is inserted into the open end of the "U". When first installed, a new roll 10 of media is held in the "U" against the force of the media being withdrawn by the weight of the material. As the roll 10 is consumed, however, the weight is insufficient to overcome the unrolling force and the support bar 12 lifts out. For this reason, a separate latching mechanism of some kind closing off the "U" must be provided. This adds to the complexity and inconvenience of changing supply rolls.

In addition, since the support bar 12 is of a fixed length, this prior art system is not readily adaptable for using different widths of plotting media.

Wherefore, it is an object of the present invention to provide a supply roll support system which is self-holding against the forces of media withdrawal even when the supply roll is close to empty.

It is another object of the present invention to provide a supply roll support system which is easily adjustable for different widths of media.

Other objects and benefits of this invention will become apparent from the description which follows hereinafter when read in conjunction with the drawing figures which accompany it.

SUMMARY OF THE DISCLOSURE

The foregoing objects have been achieved by the support bar system of the present invention for holding rolled media in a plotter or the like comprising, a support bar having a first end and a second end, the support bar being adjustable for different widths of rolled media; a first end holder holding and supporting the first end; a second end holder holding and supporting the second end, the second end holder including a U-shaped slot receiving the second end; and, biasing means for holding the second end in the U-shaped slot against lifting forces imparted as roll media supported by the support bar is unrolled.

In the preferred embodiment, the biasing means comprising, a biasing member pivotally mounted in the U-shaped slot, and biasing means for urging the biasing member towards the second end.

The support bar in one embodiment comprises, a fixed length bar; a collar slidably mounted on the bar for holding different width rolls of media; and, locking means for locking the collar at selected positions along the bar.

In another embodiment, the support bar comprises, an inner portion and an outer portion slidable mounted together for length adjustment of the support bar; and, locking means for locking the inner portion and the outer portion together at a fixed length orientation.

In the preferred embodiment, the biasing means is an elastomeric material; the biasing member has a first ramp portion extending from a pivot point against which the second end bears to pivot the biasing member against a biasing force of the biasing means as the second end is inserted into the U-shaped slot; and, the biasing member has a second ramp portion extending away from the second end from a point above the second end when the support bar is fully inserted in the U-shaped slot against which the second end bears when the support bar is fully inserted in the U-shaped slot whereby the biasing member must be pivoted against the biasing force of the biasing member to remove the support bar from the U-shaped slot.

DETAILED DESCRIPTION OF THE PREFERRED EMBODIMENT

Figure 1:
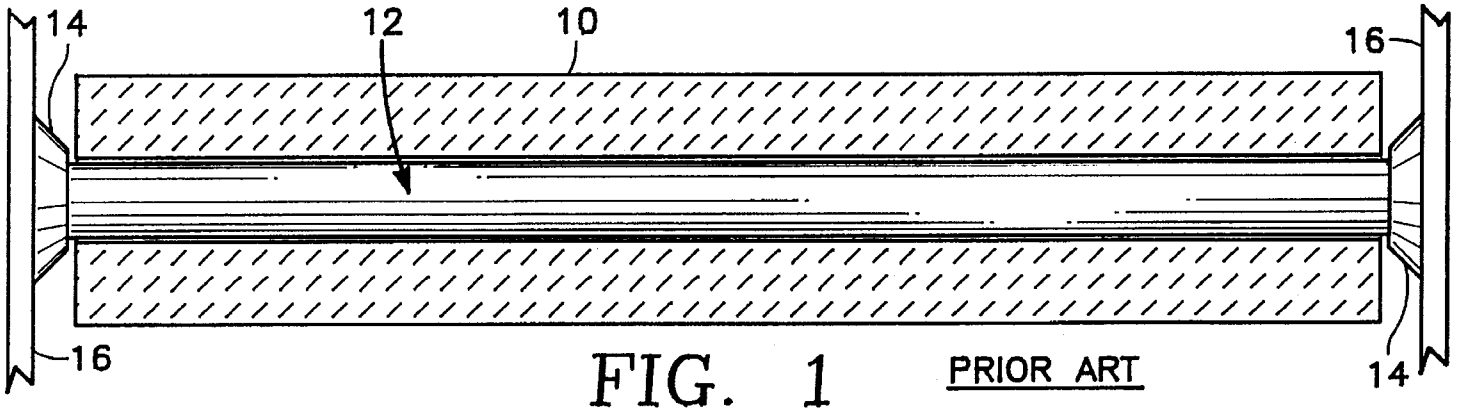
PRIOR ART FIG. 1
FIG. 1 is a partially cutaway drawing of a prior art supply roll holder.
Figure 3:
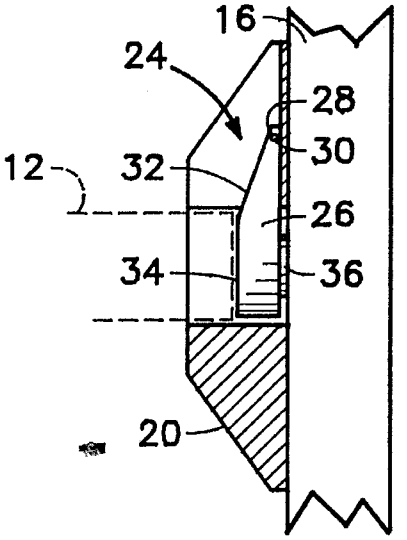
FIG. 3 is a simplified cutaway sideview drawing of the opposite end holder of a supply roll holder according to the present invention.
Figure 2:
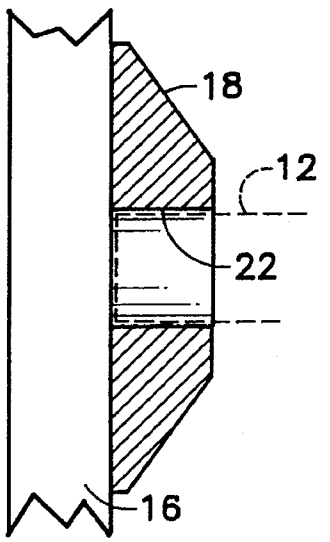
FIG. 2 is a simplified cutaway sideview drawing of one end holder of a supply roll holder according to the present invention.
Figure 4:
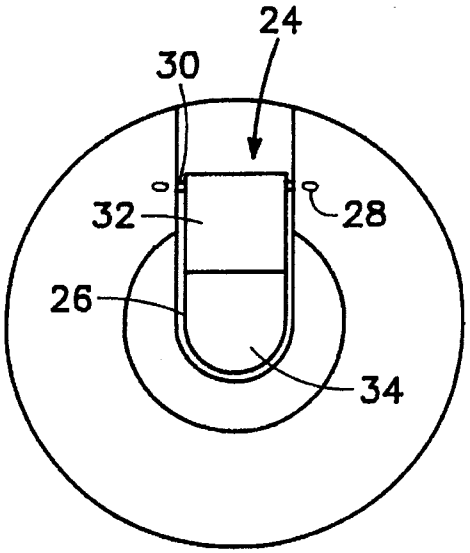
FIG. 4 is a front view of the end holder of FIG. 3.
Figure 6:
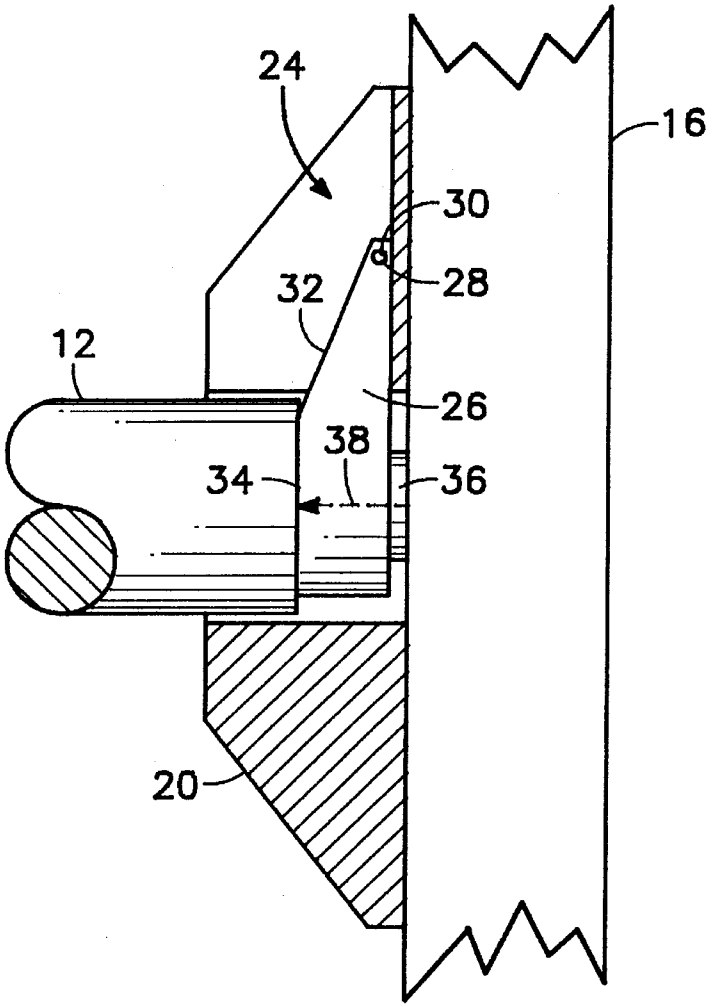
FIG. 6 is an enlarged partially cutaway drawing of the end holder of FIG. 3 shown with the roll support bar fully inserted.

The self-holding aspects of the present invention are depicted in FIGS. 2 through 6. The support bar 12 is supported on its ends by a pair of end holders 18 and 20. The one end holder 18 of FIG. 2 can be a standard cup with a cylindrical bore 22 into which one end of the support bar 12 is inserted. The other end holder 20 as depicted in FIGS. 3 through 6 includes the novel aspects of the present invention as will now be described.

Figure 5:
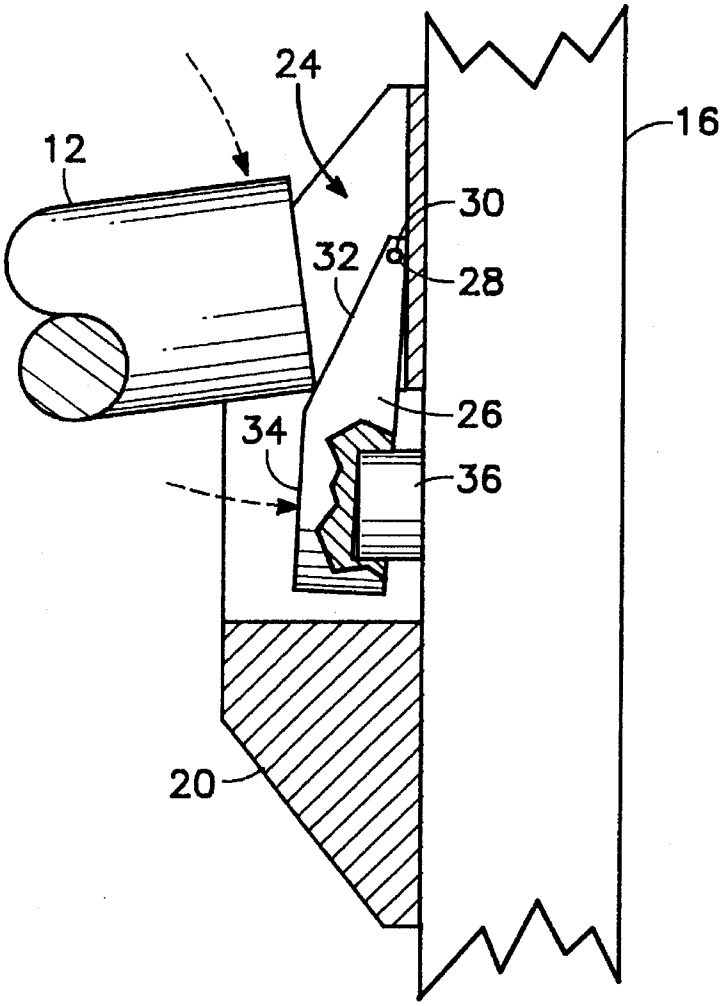
FIG. 5 is an enlarged partially cutaway drawing of the end holder of FIG. 3 shown as the roll support bar is being inserted.

The end holder 20 includes a U-shaped slot 24 as in the prior art. Within the slot 24, however, is a biasing member 26. As best seen in the enlarged drawings of FIGS. 5 and 6, the biasing member 26 is pivoted at 28 on a pivot pin 30 extending across the open end of the "U". The biasing member 26 has a ramp portion 32 extending between the pivot point 28 and a flattened portion 34 which is parallel to the end of the support bar 12 when the support bar 12 is fully inserted into the slot 24. The biasing member 26 is biased to an extended position as depicted in FIG. 5 by an elastomeric material 36. A coil spring or other form of biasing could, of course, be used. A plug of elastomeric material is simple and easy to use and is, therefore, preferred.

As can be seen in FIG. 5, the relationship between the length of the support bar 12 and the biasing member 26 in its extended position is such that the support bar 12 is longer than the space provided. Thus, as it is inserted, the end of the support bar 12 contacts the ramp portion 32 and slides down it. As the support bar 12 slides down the ramp portion 32, the biasing member 26 is pivoted about the pivot pin 30 and the elastomeric material 36 is compressed allowing the support bar 12 to be fully inserted into the slot 24. When fully inserted, the support bar 12 is under a longitudinal force as indicated by the arrow 38 as a result of the compression of the elastomeric material 36. The elastomeric material 36 and the amount of compression thereof required should be chosen such that the force 38 is sufficient to keep the support bar 12 from lifting out of the slot 24 from the withdrawing forces on the supply roll 10 even when the supply roll 10 is almost empty.

Figure 8:
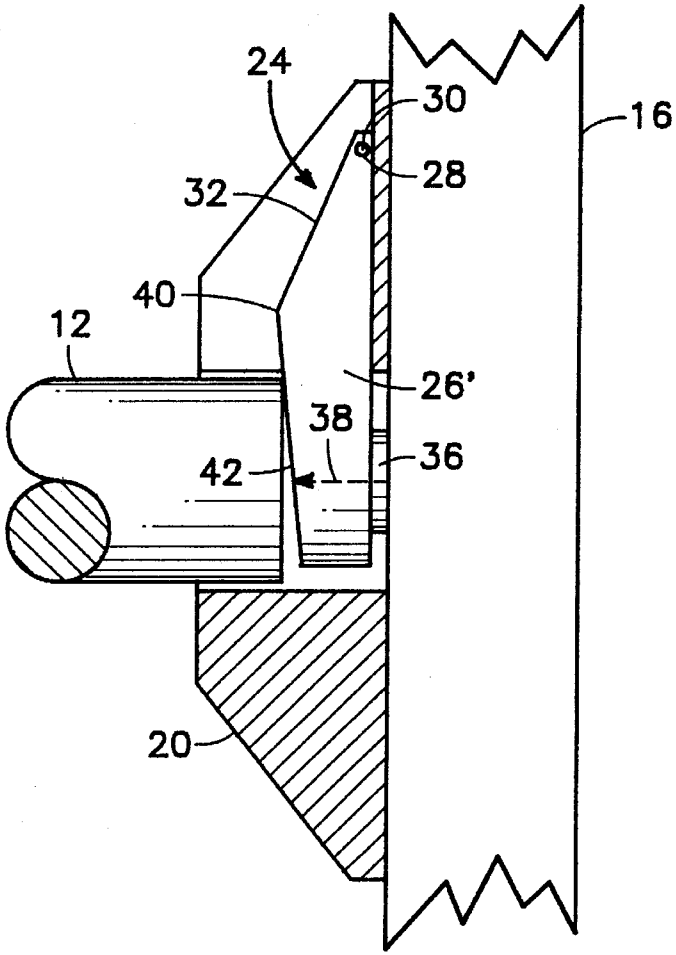
FIGS. 7 and 8 depict an alternate approach to the end holder of FIG. 3.
Figure 7:
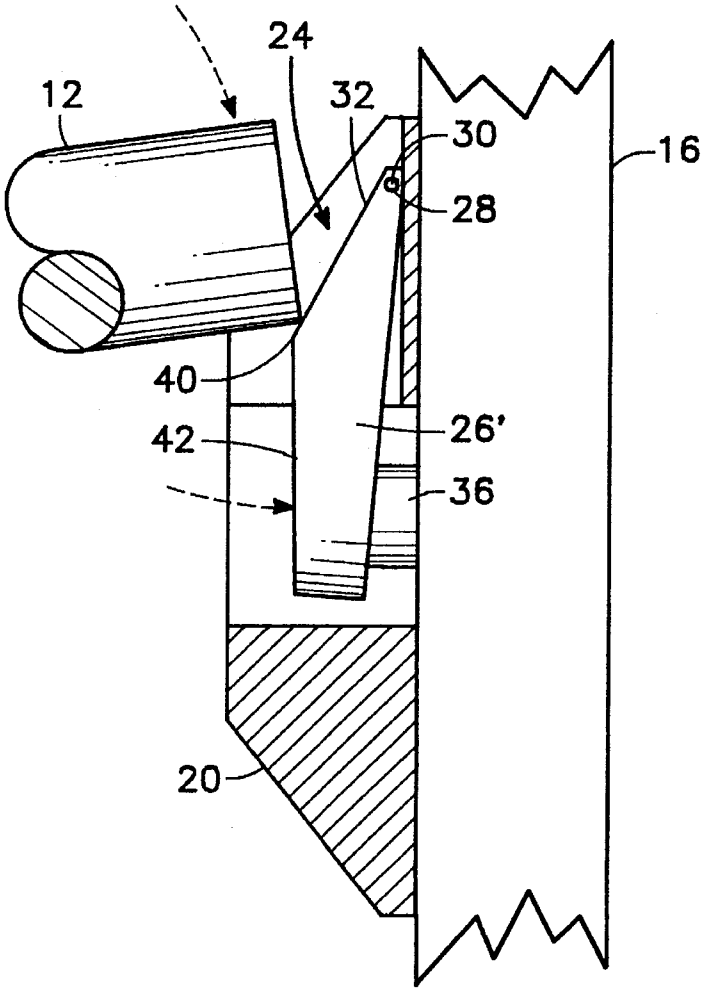

A variation of the foregoing which can be used to resist large lifting forces on the support bar and/or employ less force in the elastomeric material 36 is depicted in FIGS. 7 and 8. In this version, the biasing member 26' has a ramp portion 32 which terminates at a point 40 above the top of the support bar 12 when the support bar 12 is fully inserted into the slot 24. Instead of the flattened portion 34 to bear against the end of the support bar 12, the biasing member 26' has a reversed ramp portion 42 extending from the point 40. As depicted in FIG. 8, when the support bar 12 is fully inserted in the slot 24, the top of the support bar 12 is bearing against the reversed ramp portion 42. Thus, in order for the end of the support bar 12 to lift up, the biasing member 26' must be depressed against the force of the elastomeric material 36 and further compress the elastomeric material 36. This greatly increases the force required to lift the support bar 12 and makes it even more resistant to undesired lifting.

Figure 9:
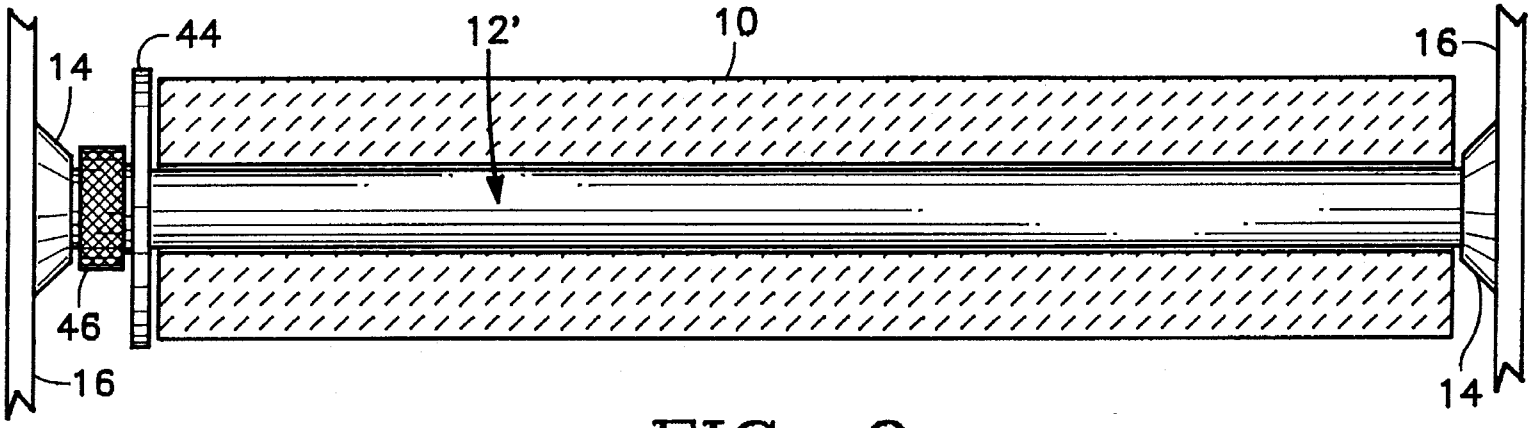
FIG. 9 is a partially cutaway drawing of a fixed length support bar for a supply roll holder according to the present invention adjustable for different widths of media shown holding a wide roll of plotting media.
Figure 10:
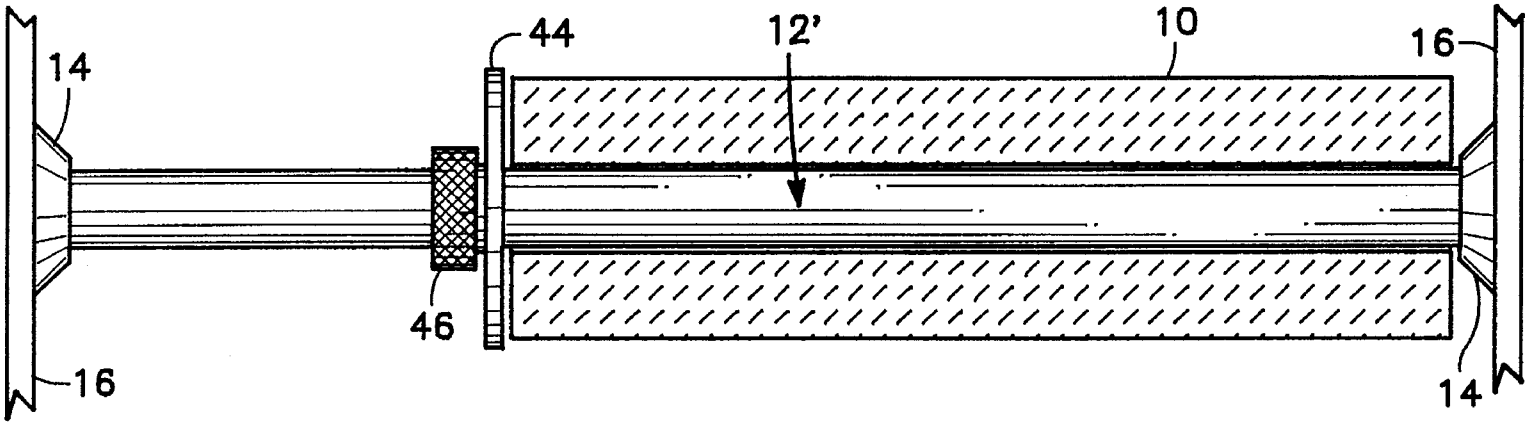
FIG. 10 shows the support bar of FIG. 9 holding a narrower roll of plotting media.

While the end holders 18, 20 as described above could be used with a standard support bar 12, it is preferred that an adjustable support bar according to the present invention be employed so as to provide all the benefits of this invention. A first adjustable support bar 12' is shown in FIGS. 9 and 10. The support bar 12' is intended to allow different widths of media to be employed. For this purpose, there is a locking adjustable sliding collar 44 mounted on one (or both) ends of the support bar 12'. The collar 44 is slidably mounted on the support bar 12' and can be locked in place by twisting the knurled knob 46. Any of several locking methods well known to those or ordinary skill in the art can be employed with the knurled knob 46. For example, the portion of the collar 44 under the knurled knob 46 can be threaded and split longitudinally with a ramped end such that as the knurled knob 46 is threadedly screwed tighter onto the underlying portion, it is squeezed tighter onto the support bar 12'. A squeezing cam action could also be employed.

Figure 11:
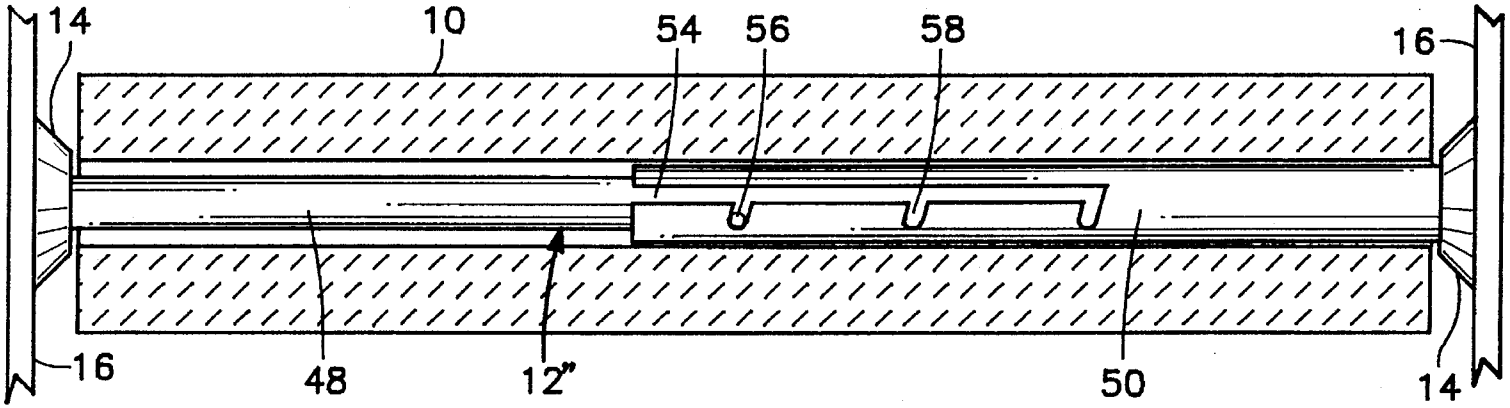
FIG. 11 is a partially cutaway drawing of an adjustable length support bar for a supply roll holder according to the present invention shown holding a wide roll of plotting media in a wide media plotter.
Figure 12:
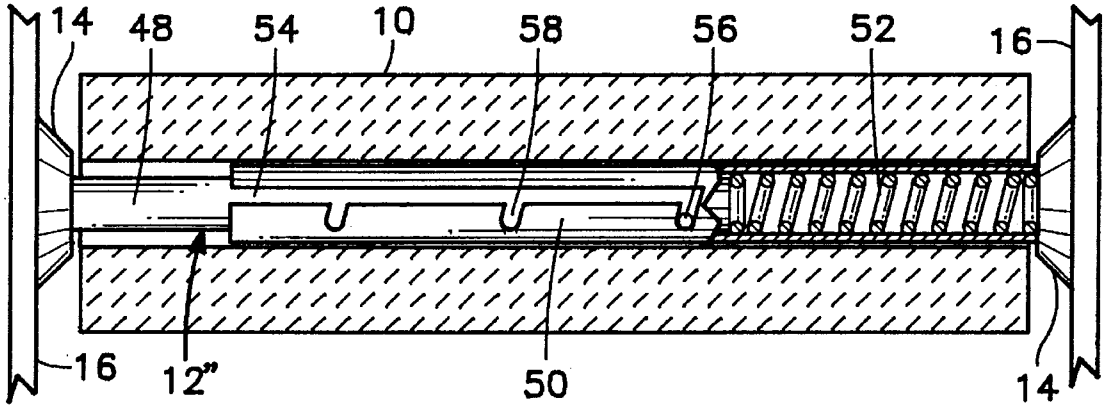
FIG. 12 shows the support bar of FIG. 11 holding a narrower roll of plotting media in a narrower media plotter.

A second adjustable support bar 12" is shown in FIGS. 11 and 12. While the prior support bar 12' was of a fixed length and adjustable to hold different widths of media, the support bar 12" is adjustable as to length so that a common support bar can be used in plotters requiring different widths of media. The support bar 12" comprises an inner bar 48 slidably mounted within a cylindrical outer bar 50. The inner bar 48 and outer bar 50 can be locked at desired positions relative to one another by various means. One approach is depicted in FIGS. 11 and 12. To prevent the two bars 48, 50 from coming apart at undesired times, they are biased to their extreme outer position of FIG. 11 by an internal spring 52. The outer bar 50 has a longitudinal slot 54 therein in which a pin 56 on the outer surface of the inner bar 48 slides. A plurality of backwardly angled locking slots 58 extend off of the longitudinal slot 54. By twisting the inner bar 48 to place the pin 56 into a selected one of the locking slots 58, the spring 52 will keep the two bars 48, 50 in their desired length orientation.

Wherefore, having thus described the present invention, what is claimed is:

1. A support bar system for holding rolled media in a plotter or the like comprising:

a) a support bar having a first end and a second end;

b) a first end holder holding and supporting said first end; and, c) a second end holder holding and supporting said second end, said second end holder including a U-shaped slot receiving said second end and means for holding said second end in said U-shaped slot against lifting forces imparted as roll media supported by said support bar is unrolled, said holding means further being capable of releasing said support bar in response to a user applying a releasing force, which is greater than said lifting forces, on said support bar, said application of the releasing force being the only action required of the user to release said support bar.

2. The support bar system of claim 1 wherein said holding means comprises:

a) a biasing member pivotally mounted in said U-shaped slot; and, b) biasing means for urging said biasing member towards said second end.

3. The support bar system of claim 2 wherein:

said biasing means is an elastomeric material.

4. The support bar system of claim 2 wherein:

said biasing member has a first ramp portion extending from a pivot point against which said second end bears to pivot said biasing member against a biasing force of said biasing means as said second end is inserted into said U-shaped slot.

5. The support bar system of claim 4 wherein:

said biasing member has a second ramp portion extending away from said second end from a point above said second end when said support bar is fully inserted in said U-shaped slot against which said second end bears when said support bar is fully inserted in said U-shaped slot whereby said biasing member must be pivoted against said biasing force of said biasing member to remove said support bar from said U-shaped slot.

6. The support bar system of claim 1 wherein said support bar includes:

a) a collar slidably mounted thereon for holding different width rolls of media; and, b) locking means for locking said collar at selected positions along said support bar.

7. The support bar system of claim 1 wherein said support bar comprises:

a) an inner portion and an outer portion slidable mounted together for length adjustment of said support bar; and, b) locking means for locking said inner portion and said outer portion together at a fixed length orientation.

8. A support bar system for holding rolled media in a plotter or the like comprising:

a) a support bar having a first end and a second end, said support bar being adjustable for different widths of rolled media;

b) a first end holder holding and supporting said first end;

c) a second end holder holding and supporting said second end; and, d) said second end holder includes a U-shaped slot receiving said second end and means for holding said second end in said U-shaped slot against lifting forces imparted as roll media supported by said support bar is unrolled, said holding means further being capable of releasing said support bar in response to a user applying a releasing force, which is greater than said lifting forces, on said support bar, said application of the releasing force being the only action required of the user to release said support bar.

9. The support bar system of claim 8 wherein said support bar comprises:

a) a fixed length bar;

b) a collar slidably mounted on said bar for holding different width rolls of media; and, c) locking means for locking said collar at selected positions along said bar.

10. The support bar system of claim 8 wherein said support bar comprises:

a) an inner portion and an outer portion slidable mounted together for length adjustment of said support bar; and, b) locking means for locking said inner portion and said outer portion together at a fixed length orientation.

11. The support bar system of claim 8 wherein said holding means comprises:

a) a biasing member pivotally mounted in said U-shaped slot; and, b) biasing means for urging said biasing member towards said second end.

12. The support bar system of claim 11 wherein:

said biasing means is an elastomeric material.

13. The support bar system of claim 11 wherein:

said biasing member has a first ramp portion extending from a pivot point against which said second end bears to pivot said biasing member against a biasing force of said biasing means as said second end is inserted into said U-shaped slot.

14. The support bar system of claim 13 wherein:

said biasing member has a second ramp portion extending away from said second end from a point above said second end when said support bar is fully inserted in said U-shaped slot against which said second end bears when said support bar is fully inserted in said U-shaped slot whereby said biasing member must be pivoted against said biasing force of said biasing member to remove said support bar from said U-shaped slot.

15. A support bar system for holding rolled media in a plotter or the like comprising:

a) a support bar having a first end and a second end, said support bar being adjustable for different widths of rolled media;

b) a first end holder holding and supporting said first end;

c) a second end holder holding and supporting said second end, said second end holder including U-shaped slot receiving said second end; and, d) means for holding said second end in said U-shaped slot against lifting forces imparted as roll media supported by said support bar is unrolled, said holding means further being capable of releasing said support bar in response to a user applying a releasing force, which is greater than said lifting forces, on said support bar, said application of the releasing force being the only action required of the user to release said support bar, said holding means comprising, d1) a biasing member pivotally mounted in said U-shaped slot, and d2) biasing means for urging said biasing member towards said second end.

16. The support bar system of claim 15 wherein said support bar comprises:

a) a fixed length bar;

b) a collar slidably mounted on said bar for holding different width rolls of media; and, c) locking means for locking said collar at selected positions along said bar.

17. The support bar system of claim 15 wherein said support bar comprises:

a) an inner portion and an outer portion slidable mounted together for length adjustment of said support bar; and, b) locking means for locking said inner portion and said outer portion together at a fixed length orientation.

18. The support bar system of claim 15 wherein:

a) said biasing means is an elastomeric material;

b) said biasing member has a first ramp portion extending from a pivot point against which said second end bears to pivot said biasing member against a biasing force of said biasing means as said second end is inserted into said U-shaped slot; and, c) said biasing member has a second ramp portion extending away from said second end from a point above said second end when said support bar is fully inserted in said U-shaped slot against which said second end bears when said support bar is fully inserted in said U-shaped slot whereby said biasing member must be pivoted against said biasing force of said biasing member to remove said support bar from said U-shaped slot.

* * * * *